United States Patent [19]

Croson

[11] 3,996,551

[45] Dec. 7, 1976

[54] CHROMIUM-SILICON OXIDE THIN FILM RESISTORS

[75] Inventor: Eddie B. Croson, Ojai, Calif.

[73] Assignee: The United States of America as represented by the Secretary of the Navy, Washington, D.C.

[22] Filed: Oct. 20, 1975

[21] Appl. No.: 624,134

[52] U.S. Cl. ..... 338/309; 29/620; 156/11; 338/314; 427/103; 427/124; 427/126

[51] Int. Cl.[2] ..... H01C 7/00

[58] Field of Search ..... 338/306–309, 338/314, 327, 328; 29/610, 620; 427/103, 101, 124, 126; 428/472, 469; 156/3, 5, 11

[56] References Cited

UNITED STATES PATENTS

| | | | |
|---|---|---|---|
| 3,398,032 | 8/1968 | Glang et al. | 29/620 X |
| 3,742,120 | 6/1973 | Keister et al. | 338/309 X |

*Primary Examiner*—C. L. Albritton
*Attorney, Agent, or Firm*—Richard S. Sciascia; Joseph M. St.Amand; William W. Cochran, II

[57] ABSTRACT

An arrangement of thin film resistive layers for hybrid microcircuits that eliminates electrical contact problems and provides a means for obtaining high precision by trimming. A thin resistive film is deposited on an insulating substrate over a mask. Without breaking vacuum, a second resistive film which is not subject to oxidation is deposited over the first resistive film. The second resistive film is then etched away from portions which are not used as contact points. Since the second resistive material has a different resistivity, it is also used for low value resistive portions in multiple resistor networks.

2 Claims, 15 Drawing Figures

CHROMIUM-SILICON OXIDE THIN FILM RESISTORS

BACKGROUND OF THE INVENTION

The present invention pertains generally to hybrid microcircuits and more specifically to thin film resistive networks.

The conventional manner of attaching electrical contacts to hybrid thin film resistors formed from chromium-silicon oxide has been to evaporate and etch aluminum or other metal pads directly to the chormium silicon oxide material. During this processing, a thin oxide film has typically formed on the surface of the chromium-silicon oxide prior to depositing the aluminum which has prevented a uniform low resistance contact between the aluminum pad connectors and the chromium-silicon oxide material. This inexact method of attaching the aluminum or other metal pad connectors to the resistive material has resulted in the existence of unstable conditions upon application of voltage to the connection or variations in temperature conditions near the connector junction. The potential for these instabilities has reduced the reliability of resistive networks fabricated in this manner.

Another problem which has also developed in generation of thin film resistive networks is the production of a high precision trimmable resistor. It has been found that certain patterns of resistive films can be etched away by lasers or other etching devices to produce a thin film resistor having a desired resistivity. However, high precision in obtaining this resistivity has not been possible due to the nature and manner of the resistive films and method of cutting, respectively. Moreover, the generation of multiple resistive networks wherein the specific resistive elements vary greatly in magnitude has not been possible in an exacting manner with a single resistive material. Since a practical method of using more than one resistive material in a simplified manner has heretofore not been available, other more complex methods were required to obtain greater precision.

SUMMARY OF THE INVENTION

The present invention overcomes the disadvantages and limitations of the prior art by providing improved chromium-silicon oxide and chromium-silicide thin film resistors. In the arrangement of the present invention, a nickel-chrome layer is deposited on a chromium-silicon oxide or chromium-silicide resistive material without breaking vacuum to prevent the formation of an oxidation layer between the chromium-silicon oxide or chromium-silicide resistive material and its electrical contacts. The nickel-chrome material, in addition, provides a low resistivity portion simplifying the construction of multiple resistive networks having a broad range of values. The nickel-chrome material is also used to provide high precision in trimmable resistive networks when used in series with a trimmable chromium-silicon oxide or chromium-silicide resistor.

It is therefore an object of the present invention to provide an improved chromium-silicon oxide and chromium-silicide film resistors.

It is also an object of the present invention to provide chromium-silicon oxide or chromium-silicide thin film resistors which are highly stable and reliable in operation under both high voltages and variations in temperature.

Another object of the present invention is to provide simplified resistive networks having a wide range of resistivities.

Another object of the present invention is to provide thin film resistors which can be trimmed with very high precision.

Another object of the invention is to provide an improved multiple resistor network.

Other objects and further scope of applicability of the present invention will become apparent from the detailed description given hereinafter. The detailed description indicating the preferred embodiment of the invention is given only by way of illustration since various changes and modifications within the spirit and scope of the invention will become apparent to those skilled in the art from this detailed description. The foregoing abstract of the disclosure is for the purpose of providing a non-legal brief statement to serve as a searching, scanning tool for scientists, engineers and researchers, and is not intended to limit the scope of the invention as disclosed herein nor is it intended to be used in interpreting or in any way limiting the scope or fair meaning of the appended claims.

DETAILED DESCRIPTION OF THE PREFERRED EMBODIMENT

Figure 1A:
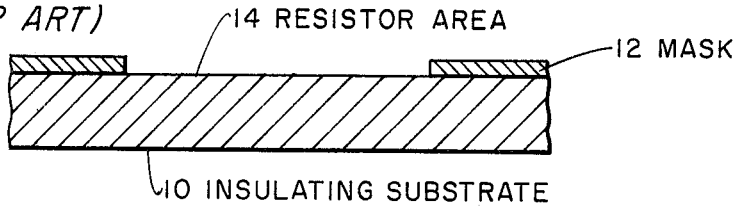
Fig. 1a. (PRIOR ART)
FIG. 1*a* illustrates a substrate with a disposable mask.
Figure 1B:
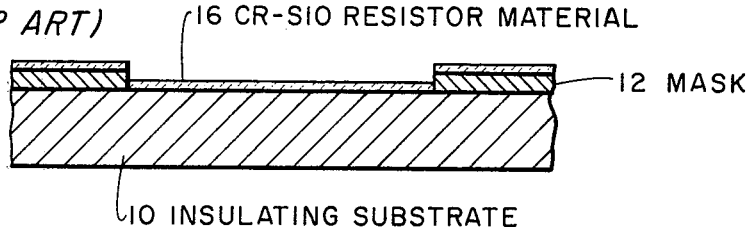
Fig. 1b. (PRIOR ART)
FIG. 1*b* illustrates a resistor material overlying the mask and substrate.
Figure 1C:
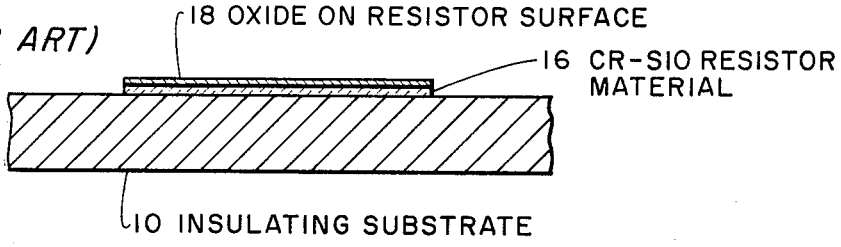
Fig. 1c. (PRIOR ART)
FIG 1*c* illustrates the resistive material, a thin oxide layer over the resistive material with the mask removed.
Figure 1D:
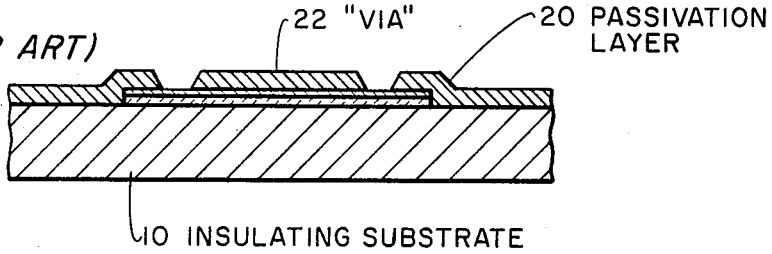
Fig. 1d. (PRIOR ART)
FIG. 1*d* illustrates the resistive pattern covered by a passivation protection layer.
Figure 1E:
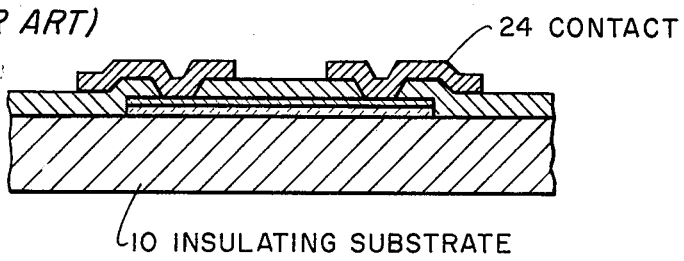
Fig. 1e. (PRIOR ART)
FIG. 1*e* illustrates the completed hybrid resistor pattern with attached aluminum contacts.

FIGS. 1*a* through 1*e* illustrate the prior art method of forming hybrid microresistive circuits of chromium-silicon oxide. As shown in FIG. 1*a*, an insulating substrate of oxidized silicon, aluminum oxide or other similar material is masked with a disposable aluminum or copper mask 12. A layer of chromium-silicon oxide 16 is deposited on the substrate 10 in the resistive area 14 and, in addition, over the mask 12, in a high vacuum, by flash or evaporation techniques or sputtering. As shown in FIG. 1*c*, the masks are removed after breaking the vacuum and the chromium-silicon oxide resistive material 16 is left in a pattern on the face of the insulating substrate 10. Since vacuum is broken, an oxide layer 18 is formed on the resistive surface. As shown in FIG. 1*d*, a passivation layer 20 of dielectric material is deposited over the insulating substrate 10 of the resistive material 16 by any one of a number of ways, such as by chemical vapor phase disposition evaporation, sputtering, etc. Following disposition of the passivation layer 20, vias 22 are etched in the passivation layer to form contact holes so that contacts 24 can be secured to the resistive material, as shown in FIG. 1*e*.

Figure 2A:
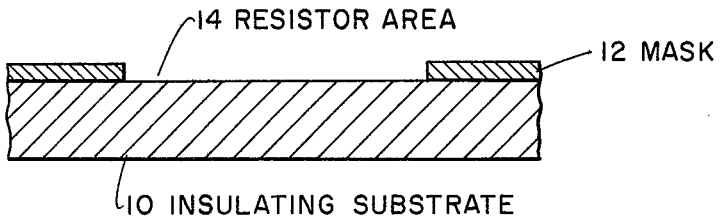
FIG. 2*a* illustrates a substrate and disposable mask.
Figure 2B:
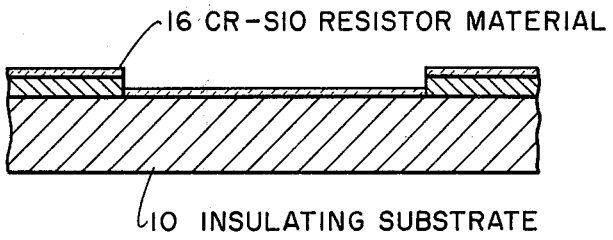
FIG 2*b* illustrates the deposited resistor material on the substrate and mask.
Figure 2C:
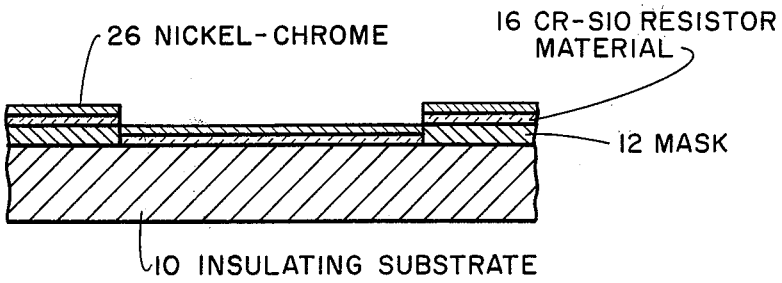
FIG. 2*c* illustrates the deposited nickel-chrome material over the resistive material.

FIGS. 2*a* through 2*e* illustrate the improved chromium-silicon oxide thin film resistors comprising the preferred embodiment of the invention. As shown in FIG. 2*a*, a covnventional insulating substrate 10 and an aluminum or copper mask 12 are used to form the resistive pattern. In FIG. 2*b*, the chromium-silicon oxide resistive material 16 is applied to the mask 12 and substrate 10 by evaporation techniques in a high vacuum or sputtering. Immediately following dispostion of the chromium-silicon oxide film to the desired resistivity, a second layer consisting of approximately 80% nickel and 20% chromium, or other suitable mixture, is deposited over the chromium-silicon oxide film to a thickness of approximately 200 angstroms and a resistivity of approximately 100 ohms per square, without breaking vacuum.

Figure 2D:
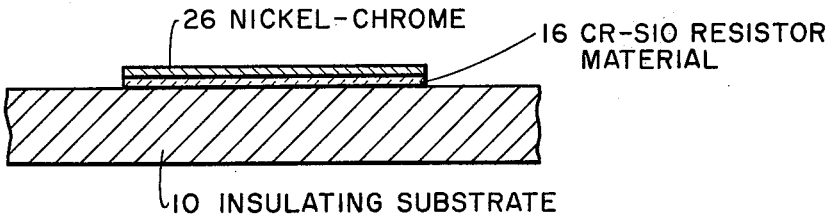
FIG. 2*d* illustrates the chromium-silicon oxide resistive material with its nickel-chrome coating after the removal of the mask.
Figure 2E:
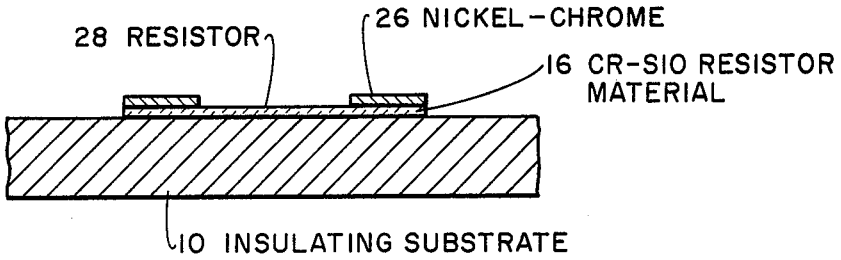
FIG. 2*e* shows the resistive pattern after a portion of the nickel-chrome layer has been etched away.

Since the nickel-chrome layer is deposited during the same vacuum pump down, the chromium-silicon oxide film is not allowed to form an oxidation layer 18, as shown in FIG. 1*c*, which prevents a low resistive contact between the chromium-silicon oxide and the metal contact. After the disposition chamber is cooled to a temperature of less than 100° centigrade, the substrates are removed from the vacuum system and the masks are chemically etched away, removing all of the undersired chromium-silicon oxide and nickel-chrome layer. A resistor pattern is left on the insulating substrate consisting of a layer of chromium-silicon oxide overcoated with a nickel-chrome layer, as shown in FIG. 2*d*. The laminar structure is then cleaned and the substrates are patterned with photoresist and undesired nickel-chrome is selectively etched off the resistor pattern in all areas except where the electrical contacts are going to be attached, as shown in FIG. 2*e*. A passivation layer and electrical contacts are then applied to the laminar structure in the same manner as shown in FIGS. 1*d* and 1*e*.

Since the nickel-chrome layer does not oxidize, a low resistance contact can be made between the electrical contact and the chromium-silicon oxide resistive material. As a result, the magnitude of resistance of the chromium-silicon oxide layer does not vary with the application of voltage or changes in temperatures, as was prevalent in conventional methods of attaching electrical contacts through oxidation layers.

Figure 3A:
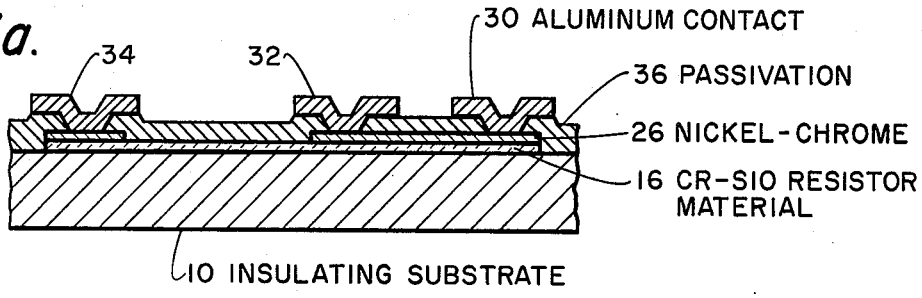
FIG. 3*a* is a side view of a multiple resistive network.
Figure 3B:
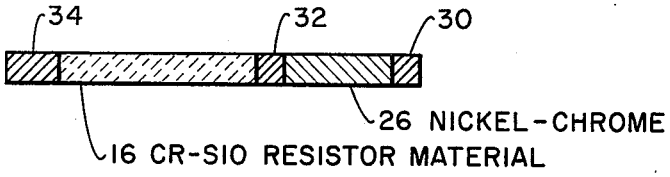
FIG. 3*b* is a top view of a multiple resistive network.
Figure 3C:
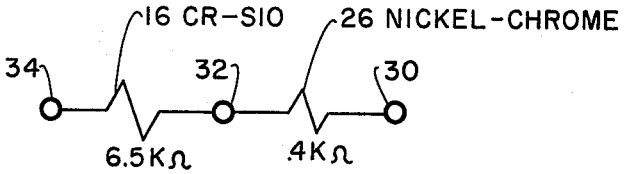
FIG. 3*c* is a schematic diagram of the resistive network, shown in FIGS. 2*a* and 2*b*.

FIGS. 3*a* through 3*c* show the nickel-chrome layers arranged to form a multiple resistive network pattern. FIG. 3*a* is a side view of a typical multiple resistive pattern wherein the nickel-chrome layer 26 has not been etched between aluminum contacts 30 and 32. This is more clearly shown in FIG. 3*b*, which is a top view of just the resistive material and contact areas. As shown therein, the nickel-chrome layer 26 completes a circuit between contact points 30 and 32 but has been etched away between the contact points 32 and 34. Since the resistacne of the nickel-chrome layer is must lower than that of the chromium-silicon oxide, the resistance between contact points 30 and 32 is much less than the resistance between contact areas 32 and 34. By using this simple method of selectively etching away the nickel-chrome material, it is possible to form a resistor array in a very simple manner which incorporates large differences in resistivity between the individual elements. An illustration of a typical schematic diagram of the resistive array shown in figs. 3*a* and 3*b* is shown in FIG. 3*c*. As shown therein, a change of magnitude can be obtained in the resistivity of the individual resistor elements by utilizing the nickel-chrome layer as a resistive element.

Figure 4A:
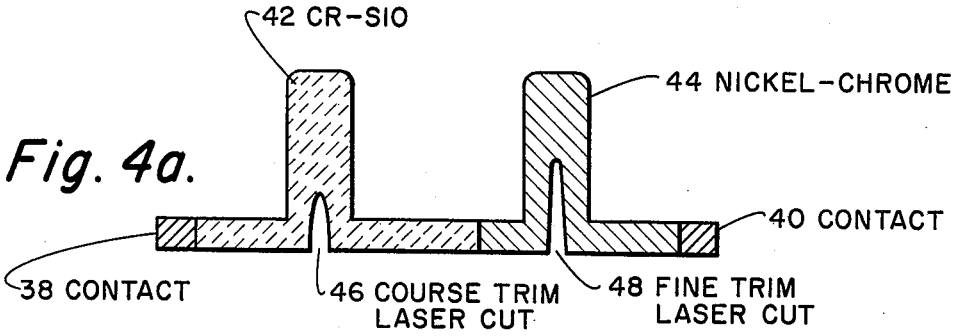
FIG. 4*a* is a top view of a high precision trimmable multiple resistive network.
Figure 4B:
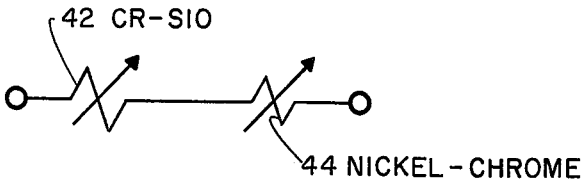
FIG. 4*b* is a schematic diagram of the resistive network of FIG. 4*a*.

FIGS. 4*a* and 4*b* illustrate the nickel-chrome material arranged to form a high precision, trimmable resistive network. As shown in FIG. 4*a*, a chromium-silicon oxide pattern 42 can be formed such that its resistance can be changed between contacts 38 and 40 by etching away a portion of the resistive material by the use of a laser or similar cutting device. When used in series with a similar nickel-chrome pattern 44, the chromium-silicon oxide pattern can be coarsely trimmed, such as shown at 46, and finally trimmed with very high precision by fine trim laser cut 48. This allows a highly exact resistivity to be obtained between the contacts 40 and 38 due to the difference in magnitude of resistivity between the chromium-silicon oxide material and the nickel-chrome material.

The schematic diagram for the resistive patterns of FIG. 4*a* is shown in FIG. 4*b*. As shown in FIG. 4*b*, the chromium-silicon oxide resistive element 42 and the nickel-chrome resistive element 44 can both be adjusted in magnitude.

In using the preferred embodiment of the invention, the attachment problems between the chromium-silicon oxide film and the electrical connectors are virtually eliminated due to the fact that a low resistive contact can be made between the electrical contact and the chromium-silicon oxide film before an oxidation layer can be generated. Since the nickel-chrome material does not form an oxidation layer in the same manner as the chromium-silicon oxide film, the low resistive attachment between the metal contacts and the chromium-silicon oxide material can be achieved. The nickel-chrome contact pads can also function as an etch stop if silicon oxide is used as a passivation layer, since etching of silicon oxide also attacks the chromium-silicon oxide and can easily damage or destroy the resistive film. Furthermore, the nickel-chrome layer can be used as a low resistance material in conjunction with the chromium-silicon oxide film so that multiple resistivities can be obtained in the same resistive network pattern. Moreover, as pointed out in FIG. 4*a* and 4*b*, the nickel-chrome material can be used as a trimmable resistor to achieve a highly precise resistive value in a trimmable resistive network.

Obviously many modifications and variations of the present invention are possible in light of the above teachings. For example, other materials can be used in place of the chrome-silicon oxide coating such as chrome-silicide. In addition, a metal layer of nickel can be used in lieu of nickel-chrome alloy. Additionally, other methods of masking and etching can be used to form the resistive pattern other than those described herein, such as dry pasma etching and sputter etching. It is therefore to be understood that within the scope of the appended claims the invention may be practiced otherwise than as specifically described.

What is claimed and desired to be secured by Letters Patent of the United States is:

1. A thin film multiple resistive network comprising:

a. an insulating substrate;

b. a film of chromium-silicon oxide deposited on said substrate;

c. a layer of nickel-chrome over said film of chromium-silicon oxide in preselected areas;

d. electrical connectors attached to said layer of nickel-chrome;

e. wherein said nickel-chrome layer forms a closed circuit between at least two of said electrical connectors.

2. The multiple resistive network of claim 1 werein said film of chromium-silicon oxide and said layer of nickel-chrome form a resistive pattern which can be etched to form a high precision trimmable resistor.

* * * * *